US005215606A

United States Patent [19]

Tsukamoto

[11] Patent Number: 5,215,606

[45] Date of Patent: Jun. 1, 1993

[54] METHOD FOR PREPARING DECORATIVE LACQUERED TI-BASED ARTICLES

[75] Inventor: Shoji Tsukamoto, Tokyo, Japan

[73] Assignee: Zivaco, Co., Ltd., Tokyo, Japan

[21] Appl. No.: 633,157

[22] Filed: Dec. 21, 1990

Related U.S. Application Data

[63] Continuation of Ser. No. 393,701, Aug. 14, 1989, abandoned.

[30] Foreign Application Priority Data

Aug. 15, 1988 [JP] Japan ..... 63-202919

[51] Int. Cl.[5] ..... C25D 7/00

[52] U.S. Cl. ..... 148/518; 205/118; 205/120; 205/171; 205/209; 205/212; 205/224

[58] Field of Search ..... 148/13.1, 127, 133, 148/518; 204/15, 18.1, 37.6, 38.1, 38.3; 205/118, 120, 171, 209, 212, 224

[56] References Cited

U.S. PATENT DOCUMENTS

| | | | |
|---|---|---|---|
| 3,309,291 | 3/1967 | Icxi | 204/18.1 |
| 3,450,606 | 6/1969 | Darrow | 204/18.1 |
| 3,839,163 | 10/1974 | Kaneda et al. | 204/18.1 |
| 3,989,876 | 11/1976 | Moji et al. | 204/38.3 |
| 4,309,461 | 1/1982 | Shibata | 204/18.1 |

FOREIGN PATENT DOCUMENTS

| | | |
|---|---|---|
| 2010488 | 9/1971 | Fed. Rep. of Germany . |
| 2638195 | 3/1978 | Fed. Rep. of Germany . |
| 52-22534 | 2/1977 | Japan . |
| 57-149493 | 9/1982 | Japan . |
| 1-4491 | 1/1989 | Japan . |
| 522516 | 5/1972 | Switzerland . |
| 0850758 | 7/1979 | U.S.S.R. . |

OTHER PUBLICATIONS

Metadex Abstract 86(9)55-1870 1986.

Nippon Shikko, Nippon No Shikko (Urushi Industries in Japan, Urushi Arts and Crafts of Japan), Item 1.

Patent Abstracts of Japan, vol. 11, No. 185 (C-428)(2632) JP 62-10299 (Jan. 19, 1987).

Patent Abstracts of Japan, vol. 11, No. 268(C-444)(2715) JP 62-70599 (Apr. 1, 1987).

*Primary Examiner*—R. Dean

*Assistant Examiner*—Margery S. Phipps

*Attorney, Agent, or Firm*—Seed and Berry

[57] ABSTRACT

A method for preparing decorative lacquered Ti-based articles is disclosed, which method comprises the steps of: (a) heating to 900° to 1300° in vacuum a base of titanium or its alloy whose surface serves as a base material, to grow the crystal grains on the surface of the base while simultaneously thermally etching the surface, so as to make the base surface uneven; (b) cooling the base; (c) etching the surface of the base with an etchant to enlarge the unevenness of the surface; (d) anodizing the base; (e) applying an undercoat onto the surface of the base; (f) optionally heating the undercoat to cure the same; and (g) further applying a coating onto the undercoat and then drying it. The method makes it possible to prepare decorative lacquered Ti-based articles having a Raden-, Hyomon- or Heidatsu, Kyushitsu- or Makie-like appearance utilizing titanium or its alloy as a base material.

37 Claims, 5 Drawing Sheets

FIG. 1-A
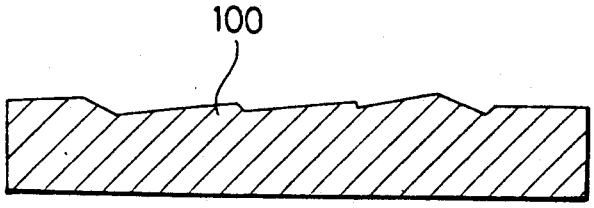
FIG. 1-B
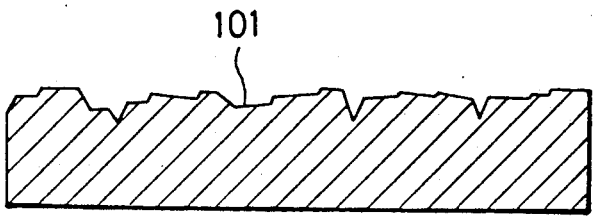
FIG. 1-C
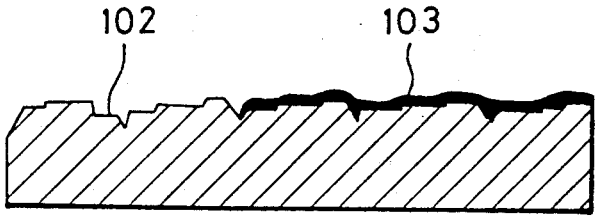
FIG. 1-D
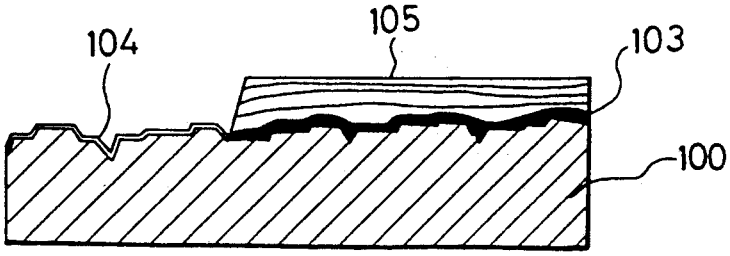
FIG. 1-E
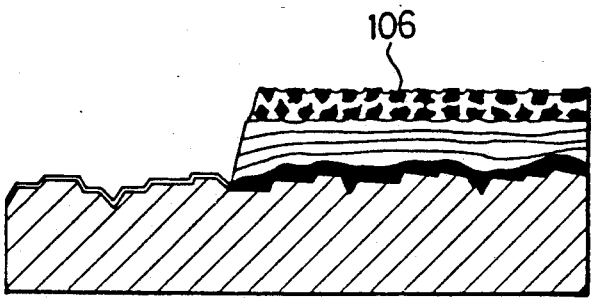

FIG. 1 – F
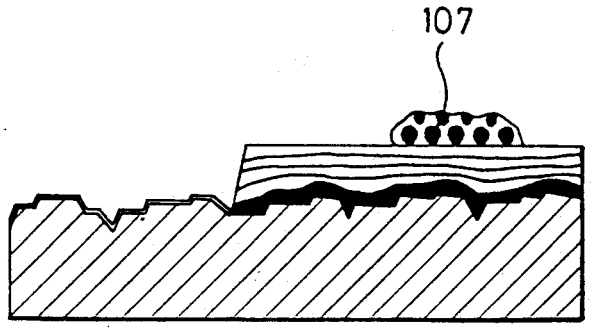
FIG. 1 – G
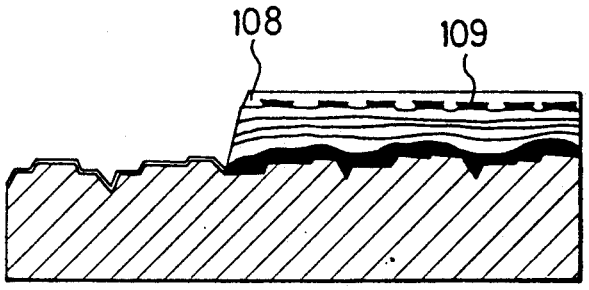
FIG. 1 – H
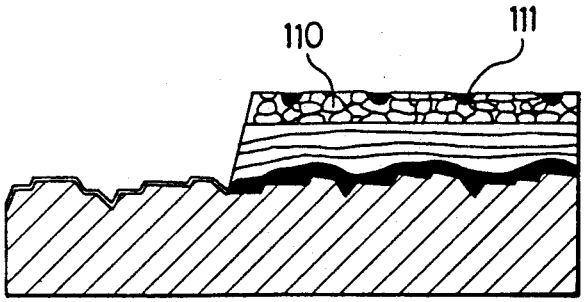
FIG. 1 – I
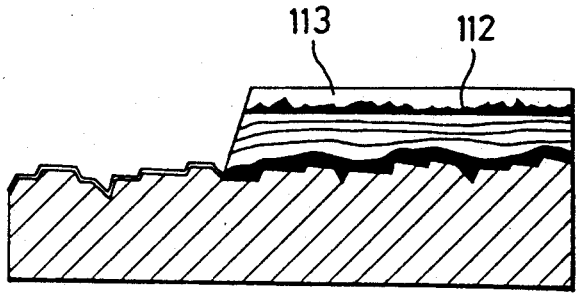

METHOD FOR PREPARING DECORATIVE LACQUERED TI-BASED ARTICLES

CROSS-REFERENCE TO RELATED APPLICATION

This application is a continuation of U.S. application Ser. No. 07/393,701 filed Aug. 14, 1989, now abandoned.

FIELD OF THE INVENTION

The present invention relates to a method for preparing a metal-based urushi ware-like product, and more particularly to a method for preparing a metal-based urushi ware-like product having a Raden-, Hyomon- or Heidatsu-, Kyushitsu- or Makie-like appearance utilizing titanium and alloys thereof as a base material.

BACKGROUND ART

Definitions of Special Terms Herein Used (1) "Metal-based Urushi Ware" means lacquered (or japanned) wares whose substrate comprises a metal such as aluminum, iron, gold or silver (in the present invention, the substrate is made of titanium).

(2) "Makie" means lacquered or urushi arts and crafts on which a picture, a pattern or the like is depicted with urushi, a powder of gold, silver or the like is spread over the surface, and the surface is further processed by, for instance, coating with a transparent layer and polishing it.

(3) "Raden" is a lacquered or japanned art or craft (urushi wares or the like) wherein small pieces of turban shell, ear shell, pearly oyster shell or the like are set in the surface so that the gloss side (inside) of the shell is exposed.

(4) "Hyomon, Heidatsu or Kanagai" is a kind of lacquering method or products obtained by such a method, the method being the same as that used in Raden except that a small thin plate or foil of a metal such as gold, silver or tin is used in place of small pieces of shell.

(5) "Kyushitsu" means a method of coating a substrate with urushi or products obtained by such a method.

(6) "Kurome" means the removal of moisutre from raw liquid urushi by irradiating the surface thereof with radiant heat with stirring.

(7) "Natsume" is a kind of container for storing green tea for presenting it and having a shape like a jujube or Chinese date.

(8) "Kuroroiro-nuri or -coating" is a black-colored urushi without drying oil or a method using such urushi.

(9) "Tame-nuri or -coating" is a kind of lacquering method or products obtained by coating a base with cinnabar red or the like, followed by applying a transparent urushi on the coating, drying it, and polishing it.

(10) "Shunkei-nuri or -coating" means a kind of lacquering or japanning method in which a wooden base is colored or pigmented yellow, red or the like and then a transparent lacquer or urushi is applied on the surface so that the texture of the wooden base can be seen through the lacquer layer.

(11) "Kijiroiro-nuri or -coating" is the same as Shunkei-nuri except that the wooden base is not colored or pigmented.

Metals such as iron, brass, aluminum and alumite are used in place of wood base material in Makie.

However, when urushi wares are formed using iron and brass as base materials, various problems arise during preparation of such an urushi ware-like product. For instance, these metals have a very high specific gravity and they are susceptible to corrosion if they come in direct contact with air. Thus, their applications as the base material for making urushi ware-like products is limited to a very narrow range from the viewpoint of manufacture. On the other hand, when alumite and aluminum are used as the base material, these metals are light and show high strength and, therefore, they can provide excellent products. However, aluminum and alumite per se have silver-covered surfaces and hence do not provide any particular aesthetic effect, and if they are used in such a condition that they come in contact with air, they are corroded by acids, alkalis or air itself.

In general, a coated film of, for instance, urushi has many pinholes. Therefore, water or moisture can diffuse through such pinholes and reach the base material even if it is covered with such a coated film, and thus the base material suffers corrosion. For this reason, conventional metallic base materials are susceptible to corrosion, and the film coated thereon is liable to be peeled off and hence the durability thereof is impaired. As a result, metals such as iron and brass have not been used as the base material for manufacturing products coated with urushi. Furthermore, metals such as aluminum and alumite, which show high strength and are light, are used as a mere substrate, and they are seldom used in such a manner that a part thereof is exposed to serve as a decorative portion.

A technique is known which comprises heating titanium or titanium alloy materials at 900° C. to 1300° C. in vacuo to grow crystal grains on the surface of the material while simultaneously thermally etching the surface, and then anodizing it, to develop interference multicolor on the metal surface (Japanese Patent Publication for Opposition Purpose, hereunder refereed to as "J. P. KOKOKU," No. Sho 53-23773 published in 1978).

SUMMARY OF THE INVENTION

Accordingly, the object of the present invention is to provide a method for preparing a metal-based urushi ware-like product, and more particularly a method for preparing a metal-based urushi ware-like product which exhibits a Raden-, Hyomon- or Heidatsu-, Kyushitsu- or Makie-like appearance utilizing titanium and alloys thereof (hereinafter referred to as "titanium") as a base material.

The inventor of this invention has conducted various studies on the applications of the foregoing technique and has discovered that there can be obtained a metal-based urushi ware-like product exhibiting a Raden-, Hyomon- or Heidatsu-, Kyushitus- or Makie-like appearance utilizing titanium as the decorative base material obtained according to the foregoing technique and having interference multi-color by itself. The resultant product is light and excellent in durability and makes it possible to effectively utilize the interference multicolor. The present invention has been completed based on this finding.

According to one aspect of the present invention, there is provided a method for preparing a metal-based urushi ware-like product which comprises the steps of (a) heating to 900° to 1800° C. in vacuo a titanium base whose surface serves as a base material to grow crystal grains on the surface of the titanium base while simultaneously thermally etching the surface so as to make the surface of the titanium base uneven; (b) cooling the titanium base; (c) etching the surface of the titanium base with an etchant such as hydrofluoric acid to enlarge the unevenness of the surface; (d) anodizing the titanium base; (e) applying an undercoating onto the surface of the titanium base; (f) optionally heating the undercoat to cure the same; and (g) further applying a coating onto the undercoat and then drying it.

According to another aspect of the present invention, there is provided a method for preparing a metal-based urushi ware-like product which comprises the steps of (a) heating to 900° to 1300° C. in vacuo a titanium base whose surface serves as a base material to grow crystal grains on the surface of the titanium base while simultaneously thermally etching the surface so as to make the surface uneven; (b) cooling the titanium base; (c) etching the surface of the titanium base with an etchant such as hydrofluoric acid to enlarge the unevenness of the surface; (d) applying an undercoat onto the surface of the titanium base except for portions providing an aesthetic effect as the base material; (e) heating the undercoat to cure the same; (f) further applying a coating onto the undercoat and then drying it; and (g) anodizing the exposed titanium base.

According to a further aspect of the present invention, there is provided a method of preparing a metal-based urushi ware-like product which comprises the steps of (a) heating to 900° to 1300° C. in vacuo a titanium base whose surface serves as a base material to grow crystal grains on the surface of the titanium base while simultaneously thermally etching the surface so as to make the surface uneven; (b) cooling the titanium base; (c) etching the surface of the titanium base with an etchant such as hydrofluoric acid to enlarge the unevenness of the surface; (d) applying an undercoat onto the surface of the titanium base except for portions providing an aesthetic effect as the base material; (e) heating the undercoat to cure the same; (f) anodizing the exposed titanium base; and then (g) further applying a coating onto the undercoat and then drying it.

In addition, the present invention further relates to a method for preparing a metal-based urushi ware-like product having a Makie-like appearance which comprises, in the first aspect of the present invention, spreading a powder of metals such as gold, silver and tin on the coating layer as applied onto the undercoat before it is dried, then applying a coating onto the layer, drying it and then polishing the final product.

BRIEF DESCRIPTION OF THE DRAWINGS

FIGS. 1-A to 1-I are schematic diagrams for illustrating the embodiments of the present method;

DETAILED EXPLANATION OF THE INVENTION

Figure 2:
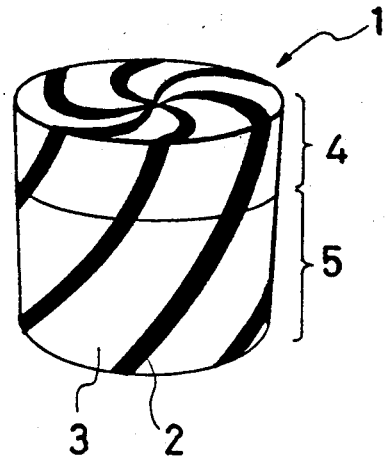
FIG. 2 is a perspective view of a Natsume prepared according to the present method.

Titanium, as used herein as the material for making a base whose surface is displayed to achieve an aesthetic effect, includes its alloys as already mentioned above. Any conventionally known titanium alloys may be used in the invention.

The titanium base may be subjected to degreasing or descaling treatment prior to the following treatment, if necessary.

Examples of the agents used in degreasing or descaling treatment include any known agents, such as hydrofluoric acid, which have conventionally been used for such purposes.

The titanium base may be divided into two portions, one of which is coated with a coating and the other of which is free of coating. The former portion is made concave so that the coated portion of the resulting urushi ware-like product does not project at least from the remaining portions.

The titanium base is first heated to 900° to 1300° C. in vacuo. Unevenness approximately corresponding to its surface crystal grains is formed on the surface of the titanium base through such a heat treatment. If the treating temperature is less than 900° C., the progress of the growth of the crystal grains and thermal etching becomes quite slow. This results in the increase in thermal processing time and the high probability of causing surface oxidation even though the heat treatment is performed in vacuo. On the other hand, if it exceeds 1300° C., the probability of causing surface oxidation becomes high since it is exposed to a very high temperature, while the processing time can be reduced.

The degree of vacuum is in general not less than $10^{-4}$ torr and preferably $10^{-5}$ to $10^{-6}$ torr. If necessary, an inert gas such as an argon gas may be used in the atmosphere.

The processing time is generally in the range of from 0.5 to 5 hours.

The heat-treated titanium base is generally cooled to room temperature, followed by etching with an etchant, such as hydrofluoric acid, to enlarge its unevenness as formed during the foregoing thermal etching. The enlarged unevenness serves to enhance the adhesion between the titanium base surface and a coating such as urushi, as will be explained below, so as to prevent the peeling off of the coating and to increase the durability of the resulting metalbased urushi ware-like product.

The preferred etchant is hydrofluoric acid. This etchant may be used in combination with an additional agent such as sulfuric acid, hydrochloric acid or nitric acid, if necessary.

The concentration of hydrofluoric acid in general ranges from 1 to 5%. In general, the higher the concentration thereof, the shorter the etching time.

In the method of this invention, the anodization is performed, for instance, by passing an electric current between the titanium base (serving as an anode) and a tantalum foil (serving as a cathode) at a current density of 3 mA/cm$^2$ in an electrolyte comprising 0.5 to 1% aqueous solution of phosphoric acid. The anodization voltage used, in general, ranges from 20 to 150 V. A variety of interference multicolors are developed on the surface of the titanium base depending on the magnitude of the voltage selected (or degree of unevenness of the surface).

For instance, when the anodization is performed at about 60 V, an interference multi-color of gold is developed and thus urushi were-like products like Hyomon (or Heidatsu) using Kanagai can be obtained. When the anodization is carried out at 65 to 85 V, interference multi-colors such as pink, reddish purple, purple and bluish purple are developed, depending on the voltage, and thus there are obtained urushi ware-like products like Raden (in which shells pigmented or dyed with a variety of colors are used). Moreover, when the anodization is performed at 90 to 100 V, interference multi-colors such as blue and bluish green are developed and thus there are obtained urushi ware-like products like Raden (in which ear shell and Mexican ear shell are used). Further, when it is carried out at 100 to 150 V, interference multi-colors such as somber silver or gray are developed and there are obtained urushi ware-like products like Hyomon (or Heidatsu) in which silver or tin is used.

An undercoat such as urushi or a stoving coating is applied onto the surface of the anodized titanium base or substrate. The undercoat is heated and cured on the uneven surface of the titanium substrate to firmly adhere the undercoat to the uneven portion of the surface. When the coating is composed of urushi, the strength of the coated film is made stronger. In this connection, when the anodization is performed at 110 to 150 V, strong adhesion between the coated film and the uneven surface can be attained by simply drying the film without heating to cure the same.

Examples of coatings as used herein are various urushis, urushiol, melamin resins, phenol resins, epoxy resins, urethane resins, acrylic resins and cashew coatings, as disclosed in "Nippon Shikko, Nippon No Shikko (Urushi Industries in Japan, Urushi Arts and Crafts of Japan), Item I, Materials and Tools," issued by the Japan Society of Urushi Industries (Corporation). Among these, preferred are urushi coatings from the viewpoint of aesthetic effects and strength of the coating. In addition, among the urushi which are preferred are those having low moisture content, such as those obtained by subjecting purified urushi, for instance, Kiurushi (raw urushi) to Kurome, so as to remove moisture therein.

These coatings are applied to the uneven surface of the titanium base, and in case it is desired to provide a Raden or Hyomon (or Heidatsu)-like appearance, the coatings are applied to the surface of the titanium base except for portions providing such an appearance.

It is common that intermediate coating and/or top coating layers are applied onto the undercoat thus cured and are then generally air-dried. The number of intermediate coating and/or top coating layers is not restricted to a specific value. As the methods for applying these layers, there may be employed those disclosed in the aforesaid "Urushi Industries in Japan" which have been used in manufacturing conventional urushi ware-like products. Specific examples thereof are urushi coating methods (or lacquering methods) such as black coating and Shunuri (vermilion-coating or method for lacquering in cinnabar red) methods such as Tame-nuri or -coating, Shunkei-nuri or -coating, Kijiro-nuri or -coating and Nashiji-nuri or -coating (sprinkled lacquer coating method).

These coatings may contain coloring agents, such as pigments and dyes, depending on the kind of metal-based urushi ware-like products. For instance, when the metal-based urushi ware-like products like Kyushitsu or Makie are to be manufactured, no coloring agent is incorporated into the coatings and a transparent coating is applied so that the interference multi-color of the titanium base shows through the coating. On the other hand, when the metal-based urushi ware-like products like Raden or Hyomon (or Heidatsu) are to be manufactured, such coloring agents as pigments or dyes are incorporated into the coating to be applied.

Specific examples thereof are those listed in the aforesaid "Urushi Industries in Japan" and they are used in the invention effectively.

The curing temperature in general ranges from 100° to 150° C. Preferred results can be obtained at a temperature falling within this range.

Although cases wherein a coating is applied after anodizing a titanium base have been explained above, the application of coatings may be performed after etching a titanium base and before anodizing the same. However, the application of coatings is preferably performed after the anodization from the viewpoint of adhesion between the coating and the surface of the titanium base because the unevenness thereof is enhanced by the anodization.

A preferred embodiment of the method of the present invention will hereunder be described in detail with reference to the attached FIG. 1.

A base 100 of pure titanium is molded into a platter shape and then the titanium platter is heated and maintained in a vacuum at a temperature of 1200° C. for four hours as shown in FIG. 1-A. Thereafter, the surface of the platter is etched with a 2% aqueous hydrofluoric acid solution for 25 minutes to make the unevenness of the surface 101 more great (FIG. 1-B). Then, a lacquer free of moisture is applied onto the surface of the titanium platter so that a part 102 is exposed. The platter is heated and maintained at 130° C. for 2.5 hours to harden the coated layer 103 and to form an underlying coating as shown in FIG. 1-C. The exposed titanium surface 102 is anodized at a voltage of 85, 90, 100 or 120 V to form an anodized layer 104. Then, a lacquer 105 is applied several times in layers onto the undercoat 103. In this case, the drying of the coating is made each time at ordinary temperature (FIG. 1-D). The lacquer coated surface is further subjected to various processes as will be explained below in detail after polishing the surface to make it smooth.

(A) Coating of Black Lacquer Dry Powder

A black lacquer is applied to the lacquer 105. Immediately thereafter, powder 106, which has been obtained by heating a black lacquer at 130° C., is spread on the lacquer. After drying it at ordinary temperature, the black lacquer is applied, followed by drying the same and polishing the resulting surface so as to obtain a pear-skin texture. A transparent lacquer is applied at a very thin thickness, followed by drying it, polishing the resulting surface, and repeating the final coating, drying and polishing processes for finishing (FIG. 1-E).

(B) Gold "Makie"

A pattern is drawn using a lacquer, immediately thereafter, round gold powder is spread on the surface, the lacquer is dried at ordinary temperature, a transparent lacquer is applied onto the resulting surface at a very thin thickness, then dried to fix the gold powder 107, and the surface is polished (FIG. 1-F).

(C) Silver "Makie"

A transparent lacquer 108 is applied onto the surface, immediately thereafter silver powder 109 having a flat shape is spread thereon. After drying it at ordinary temperature, a transparent lacquer is applied several times, then dried and the resulting surface is polished (FIG. 1-G).

(D) Coating of Cinnabar Lacquer Dry Powder and Gold-Polished "Makie"

A cinnabar lacquer is applied onto the layer 105. Immediately thereafter, cinnabar lacquer dry powder 110 and round gold powder 111 are spread thereon. After drying them at ordinary temperature, a cinnabar lacquer is applied, then dried and the resulting surface is polished to make it smooth. Further, a transparent lacquer is applied thereon at a very thin thickness, then dried. Then, the final coating, drying and polishing processes are appropriately repeated for finishing (FIG. 1-H).

(E) Cinnabar Lacquer and Transparent Lacquer Coating

A pattern is drawn using a cinnabar lacquer 112 on the layer 105. After drying it at ordinary temperature, a transparent lacquer 113 is applied several times in layers onto the surface. In this case, drying was made each time at ordinary temperature. Finally, the resulting surface is polished to make it smooth (FIG. 1-I).

The methods of this invention can be applied to various fields such as works of arts and crafts, for instance, wall painting arts, folding screens, furniture and tableware, jewelry (e.g., necklaces, brooches and earrings).

The method of the present invention will hereunder be explained in more detail with reference to the following non-limitative working examples.

EXAMPLE 1

A container and a cover therefor were produced from titanium material to form a Natsume. These parts were degreased by treating them with hydrofluoric acid, heated to 1200° C. for four hours in vacuo (argon atmosphere) and then cooled to room temperature. Then, the surfaces of the parts were etched with a 2% hydrofluoric acid solution for 25 minutes and then the parts were anodized at 95 V. The interference multicolor of bluish green was developed on the surfaces of the titanium parts through this anodization. Then, as shown in FIG. 2, urushi obtained by subjecting raw urushi (Kiurishi) to Kurome to remove its moisture was applied onto the surface (portion 3) of the parts except for a portion 2 whose surface was to be exposed, and was heated to cure the same and to form an undercoat. Using the same urushi, intermediate coats (three times) and a top coat (one time) were applied onto the undercoat. In this case, each coated layer was air-dried and the intermediate coat was dyed black by incorporating iron hydroxide into the intermediate coating. Natsume composed of cover 4 and container 5 thus produced presents a fine spectacle, like Raden in which Mexican pearl oyster shell was used.

EXAMPLE 2

Figure 3:
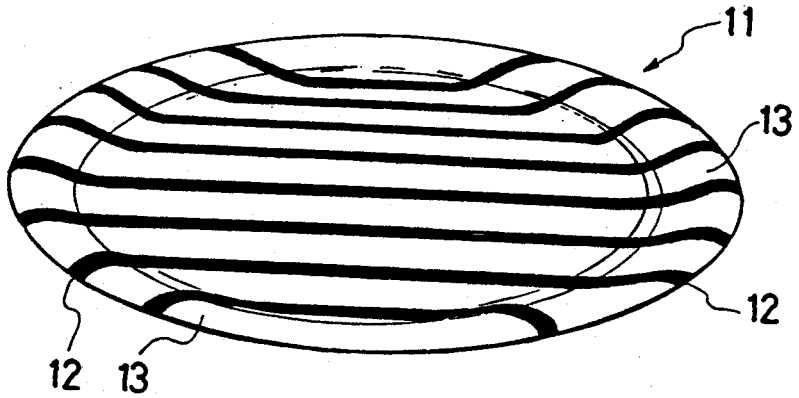
FIG. 3 is a perspective view of a dish likewise obtained according to the present method.

Titanium material was formed into a dish-like shape. Then, the same procedures as in Example 1 were repeated except that the anodization was performed at 75 V and urushi was applied onto the product (portion 13) to obtain a dish as shown in FIG. 3. As a result, the urushi ware presenting an excellent fine spectacle like Raden in which a shell dyed reddish purple (portion 12) was used.

EXAMPLE 3

Figure 4:
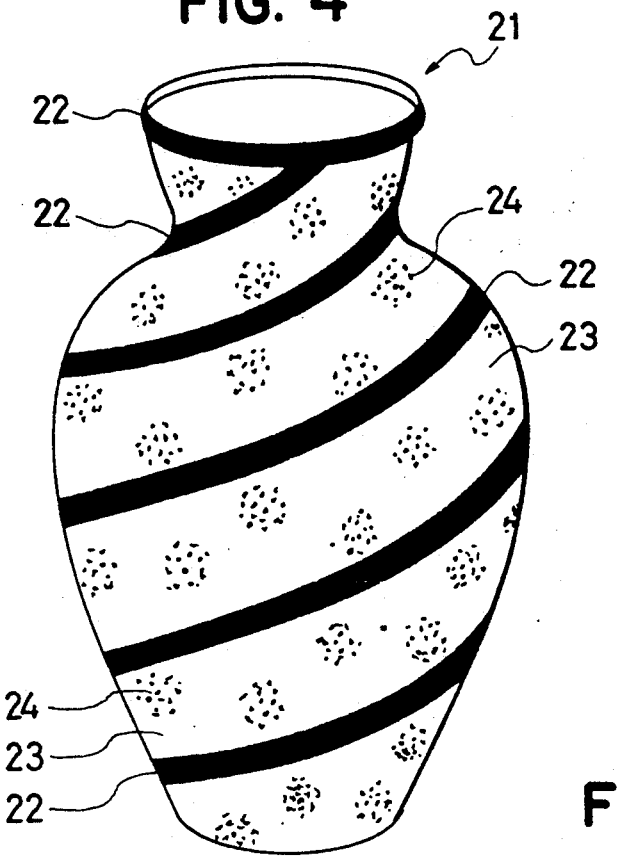
FIGS. 4 and 5 are perspective views of vases likewise obtained according to the present method.

Titanium was formed into a vase stock. The vase stock was subjected to the same procedures from vacuum treatment to anodization as in Example 1 except that the anodization was performed at 120 V. The ground surface of the vase developed interference multi-color of silver through this anodization. As shown in FIG. 4, the same urushi as used in Example 1 was applied onto the surface of the vase stock except for a band-like portion 22, followed by heating to cure the undercoat of urushi, and carrying out intermediate coating three times on the undercoat. In this case, powder of gold was spread on the final intermediate layer (portion 24) like spots before drying on the layer. After the intermediate coating layer was dried, a top coat was applied thereto one time, and then the surface of the vase was polished. The resulting vase was an urushi ware-like product presenting an excellent fine spectacle like Hyomon (or Heidatsu) wherein a part of it was treated like Makie.

EXAMPLE 4

The same procedures from the formation of a vase stock to the formation of an undercoat except for the ground surface 32 of the titanium vase stock which was to be exposed as in Example 1, were repeated. Then, intermediate coatings were applied three times without using a pigment, and powder of gold was spread over area 34 approximately in the form of a square before drying the final intermediate coating layer, followed by drying it, then applying a top coating layer onto the final intermediate layer in the same manner as in Example 3, and polishing the top coating layer.

Figure 5:
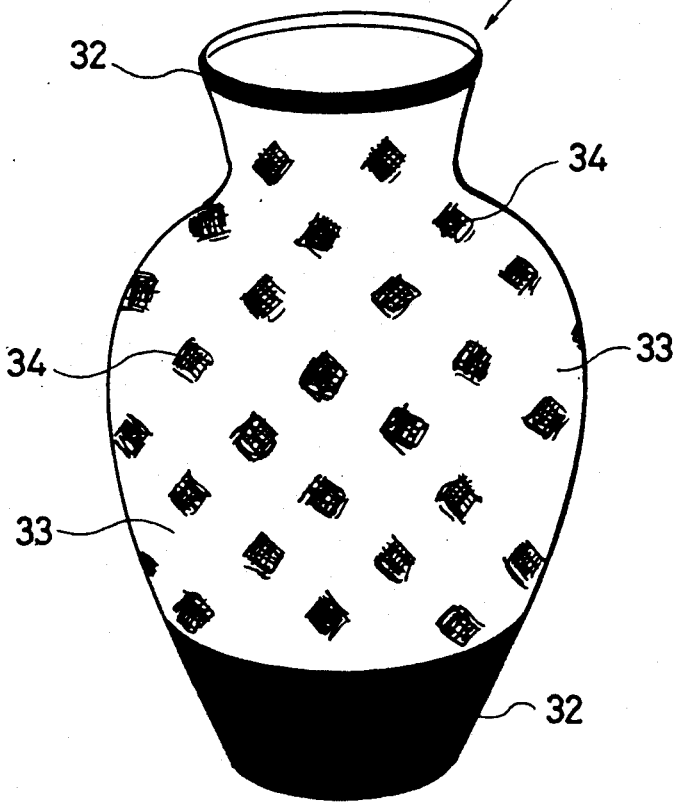

The resulting vase 31 was an excellent urushi ware-like product comprising portions like Hyomon (or Heidatsu) in which a silver colored ground surface 32 was formed and also Makie-like portions through which the surface of the titanium substrate was seen. A perspective view thereof is shown in FIG. 5.

EXAMPLE 5

Figure 6:
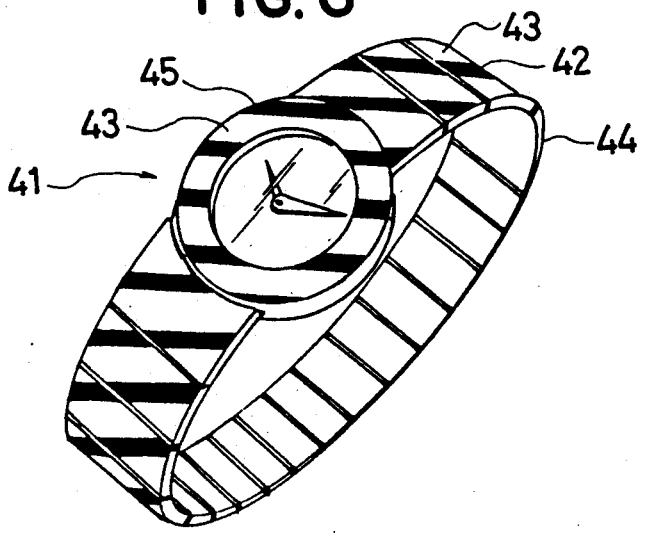
FIG. 6 is a perspective view illustrating a case and a bezel of a wristwatch likewise prepared according to the present method.

Titanium was formed into a bezel and a case for a wristwatch and then the same procedures as in Example 1 were repeated except that the anodization was performed at 100 V to form a wristwatch as shown in FIG. 6 having case 44 and bezel 45. Case 44 and bezel 45 of the resulting wristwatch were urushi ware-like products having an excellent fine spectacle like Raden in which pearl oyster shell was utilized.

EXAMPLE 6

Figure 7:
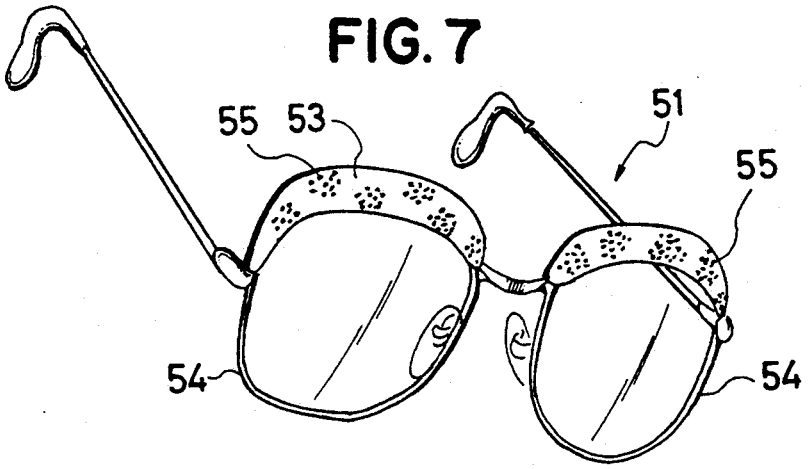
FIGS. 7 and 8 are perspective views illustrating frames of eyeglasses likewise prepared by the present method.

Using a frame stock of titanium for eyeglasses, the same procedures as in Example 1 were repeated except that the anodization was carried out at 60 V to form a titanium frame for eyeglasses showing an interference multi-color of gold. Then, an intermediate coating free of pigments was applied onto only the upper portion 55 of frame 54 followed by spreading powder of gold on the final intermediate coating layer like spots after applying the same but before drying it, drying the final intermediate coating layer, applying a top coating layer, and then polishing its surface to form a frame having a gold colored texture and presenting an excellent fine spectacle like Maki on the upper portion 55, as shown in FIG. 7.

EXAMPLE 7

Figure 8:
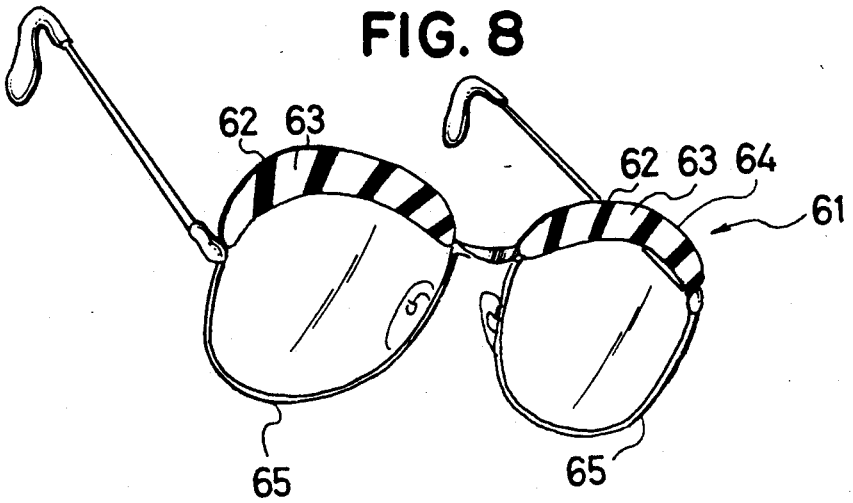

In the same manner as in Example 6, a frame stock for eyeglasses was prepared. An undercoat was applied onto the upper portion of the frame except for the portion 62 as shown in FIG. 8, followed by baking the coating layer, then applying an intermediate layer and a top layer onto the same portion and anodizing only the upper portion 64 of the frame 65 at 95 V. Alternatively, a frame for eyeglasses was also prepared in the same manner as above except that the anodization was carried out after applying an undercoat and then an intermediate layer and a top layer were applied thereto. In both cases, there were obtained frames 61 in which the upper portion 64 had the appearance of Raden employing pearl oyster shells.

It was also confirmed that similar metal-based urushi ware-like products may be prepared using a stoving resin, such as acrylic resin, instead of urushi.

What is claimed is:

1. A method for preparing a decorative lacquered Ti-based article, which comprises:

(a) heating a base of titanium or alloy thereof at a temperature ranging from about 900° C. to about 1300° C. in a vacuum for a period of time sufficient to grow crystal grains on a surface of the base to form an uneven surface;

(b) cooling the base;

(c) etching the surface of the base with an etchant to enlarge the unevenness of the surface;

(d) anodizing the base in an electrolyte solution comprising a 0.5% to 1% phosphoric acid solution, and utilizing a tantalum foil as the cathode;

(e) applying an undercoat onto the surface of the base;

(f) applying a coating onto the undercoat; and (g) drying the coating.

2. The method of claim 1 wherein the time for heating the base of titanium or alloy thereof ranges from 0.5 to 5 hours.

3. The method of claim 1 wherein the vacuum is not less than $10^{-4}$ torr.

4. The method of claim 1 wherein the vacuum ranges from $10^{-5}$ to $10^{-6}$ torr.

5. The method of claim 1 wherein the etchant is an aqueous solution comprising an acid selected from the group consisting of hydrofluoric acid, sulfuric acid, hydrochloric acid and nitric acid.

6. The method of claim 1 wherein the etchant is a 1% to 5% hydrofluoric acid solution.

7. The method of claim 1 wherein the anodizing step is performed at a voltage ranging from 20 to 150 V.

8. The method of claim 1 further including, after step (e), the step of heating the undercoat for a time sufficient to cure the undercoat.

9. The method of claim 8, wherein the undercoat is heated at a temperature ranging from 100° C. to 150° C.

10. The method of claim 1 wherein, after step (g), the coating is polished.

11. A method for preparing a decorative lacquered Ti-based article, which comprises:

(a) heating a base of titanium or its alloy at a temperature ranging from about 900° C. to about 1300° C. in a vacuum for a period of time sufficient to grow crystal grains on a surface of the base to form on uneven surface;

(b) cooling the base;

(c) etching the surface of the base with an etchant to enlarge the unevenness of the surface;

(d) applying an undercoat onto a selected portion of the base such that a portion of the base remains exposed;

(e) heating the undercoat for a period of time sufficient to cure the undercoat;

(f) applying a coating onto the cured undercoat;

(g) drying the coating;

(h) anodizing the exposed base portion in an electrolyte solution comprising a 0.5% to 1% phosphoric acid solution, and utilizing a tantalum foil as the cathode; and (i) drying the exposed base portion.

12. The method of claim 11 wherein the time for heating the base of titanium or alloy thereof ranges from 0.5 to 5 hours.

13. The method of claim 11 wherein the vacuum is not less than $10^{-4}$ torr.

14. The method of claim 11 wherein the vacuum ranges from $10^{-5}$ to $10^{-6}$ torr.

15. The method of claim 11 wherein the etchant is an aqueous solution comprising an acid selected from the group consisting of hydrofluoric acid, sulfuric acid, hydrochloric acid and nitric acid.

16. The method of claim 11 wherein the etchant is a 1% to 5% hydrofluoric acid solution.

17. The method of claim 11 wherein the undercoat is heated at a temperature ranging from 100° C. to 150° C.

18. The method of claim 11 wherein the anodizing step is performed at a voltage ranging from 20 to 150 V.

19. A method for preparing a decorative lacquered Ti-based article, which comprises:

(a) heating a base of titanium or its alloy at a temperature ranging from about 900° C. to about 1300° C. in a vacuum for a period of time sufficient to grow crystal grains of the surface of the vase to form an uneven surface;

(b) cooling the base;

(c) etching the surface of the base with an etchant to enlarge the unevenness of the surface;

(d) applying the undercoat onto a selected portion of the base such that a portion of the base remains exposed;

(e) heating the undercoat for a period of time sufficient to cure the undercoat;

(f) anodizing the exposed base portion in an electrolyte solution comprising a 0.5% to 1% phosphoric acid solution, and utilizing a tantalum foil as the cathode;

(g) applying a coating onto the cured undercoat; and (h) drying the coating.

20. The method of claim 19 wherein the time for heating the base of titanium or alloy thereof ranges from 0.5 to 5 hours.

21. The method of claim 19 wherein the vacuum is not less than $10^{-4}$ torr.

22. The method of claim 19 wherein the vacuum ranges from $10^{-5}$ to $10^{-6}$ torr.

23. The method of claim 19 wherein the etchant is an aqueous solution comprising an acid selected from the group consisting of hydrofluoric acid, sulfuric acid, hydrochloric acid and nitric acid.

24. The method of claim 19 wherein the etchant is a 1% to 5% hydrofluoric acid solution.

25. The method of claim 19 wherein the undercoat is heated at a temperature ranging from 100° C. to 150° C.

26. The method of claim 19 wherein the anodizing step is performed at a voltage ranging from 20 to 150 V.

27. A method for preparing a decorative lacquered Ti-based article, which comprises:

(a) heating a base of titanium or alloy thereof at a temperature ranging from about 900° C. to about 1300° in a vacuum for a period of time sufficient to grow crystal grains on a surface of the base to form an uneven surface;

(b) cooling the base;

(c) etching the surface of the base with an etchant to enlarge the unevenness of the surface;

(d) anodizing the base;

(e) applying an undercoat onto the surface of the base;

(f) applying a coating onto the undercoat;

(g) applying a metal powder on the coating; and (h) drying the coating.

28. The method of claim 27 wherein the time for heating the base of titanium or alloy thereof ranges from 0.5 to 5 hours.

29. The method of claim 27 wherein the vacuum is not less than $10^{-4}$ torr.

30. The method of claim 27 wherein the vacuum ranges from $10^{-5}$ to $10^{-6}$ torr.

31. The method of claim 27 wherein the etchant is an aqueous solution comprising an acid selected from the group consisting of hydrofluoric acid, sulfuric acid, hydrochloric acid and nitric acid.

32. The method of claim 27 wherein the etchant is a 1% to 5% hydrofluoric acid solution.

33. The method of claim 27 wherein the anodizing step is performed at a voltage ranging from 20 to 150 V.

34. The method of claim 27 further including, after step (e), the step of heating the undercoat for a time sufficient to cure the undercoat.

35. The method of claim 34 wherein the undercoat is heated at a temperature ranging from 100° C. to 150° C.

36. The method of claim 35 wherein the metal powder is selected from the group consisting of gold, silver and tin.

37. The method of claim 27 wherein, after step (h), the coating is polished.

* * * * *